US010973350B2

(12) United States Patent
Khan

(10) Patent No.: US 10,973,350 B2
(45) Date of Patent: Apr. 13, 2021

(54) EATING UTENSIL FOR FEEDING INFANTS

(71) Applicant: Faisal Khan, Frisco, TX (US)

(72) Inventor: Faisal Khan, Frisco, TX (US)

( * ) Notice: Subject to any disclaimer, the term of this patent is extended or adjusted under 35 U.S.C. 154(b) by 0 days.

(21) Appl. No.: 16/152,972

(22) Filed: Oct. 5, 2018

(65) Prior Publication Data

US 2019/0104872 A1 Apr. 11, 2019

Related U.S. Application Data

(60) Provisional application No. 62/568,500, filed on Oct. 5, 2017.

(51) Int. Cl.
*A47G 21/02* (2006.01)
*A47G 21/04* (2006.01)

(52) U.S. Cl.
CPC ..... *A47G 21/02* (2013.01); *A47G 21/023* (2013.01); *A47G 21/04* (2013.01)

(58) Field of Classification Search
CPC ..... A47G 21/02; A47G 21/04; A47G 21/023
USPC ..... 30/322, 324, 328
See application file for complete search history.

(56) References Cited

U.S. PATENT DOCUMENTS 2,126,858 A * 8/1938 Zadek ..... A47G 21/04 446/81
2,803,059 A * 8/1957 Murdock ..... A47G 21/04 30/324
4,821,417 A * 4/1989 Levine ..... A47G 21/08 30/142
5,479,708 A * 1/1996 Thomas ..... A47G 21/02 30/122
5,946,807 A * 9/1999 Crane ..... A47G 21/181 30/141
6,701,625 B1 * 3/2004 Thomason ..... A47G 21/04 30/324
2006/0080799 A1 * 4/2006 Lucente ..... A46D 1/00 15/207.2
2007/0151111 A1 * 7/2007 Hakim ..... A47G 21/02 30/324
2007/0251097 A1 * 11/2007 Terry ..... A47G 21/02 30/123
2007/0251103 A1 * 11/2007 Rhodes, III ..... A47G 21/04 30/324

(Continued)

FOREIGN PATENT DOCUMENTS

DE 38 02 694 A1 * 8/1989
GB 392877 * 5/1933

(Continued)

OTHER PUBLICATIONS

English translation of Abstract of KR 2001-0046491, dated Jun. 2001.*

*Primary Examiner* — Hwei-Siu C Payer
(74) *Attorney, Agent, or Firm* — Richard Eldredge; Leavitt Eldredge Law Firm

(57) ABSTRACT

An eating utensil adapted for feeding infants includes an elongated handle, having a neck connected to a first end of the elongated handle; a feeding head secured to the neck, the feeding head having a soft outer shell; and a core composed of cotton and extending from the neck into an interior of the feeding head; the core maintains the shape of the feeding head; the soft outer shell provides a barrier between an infant's mouth and the core.

3 Claims, 3 Drawing Sheets

(56) References Cited

U.S. PATENT DOCUMENTS

| | | | | |
|---|---|---|---|---|
| 2010/0005667 | A1* | 1/2010 | Weigl, Jr. | A47G 21/02 30/142 |
| 2011/0219631 | A1* | 9/2011 | Hou | A47G 19/02 30/322 |
| 2011/0239470 | A1* | 10/2011 | Hemstreet | A47G 21/02 30/327 |
| 2014/0310961 | A1* | 10/2014 | James | A47G 21/02 30/150 |
| 2016/0358512 | A1* | 12/2016 | Gonshor | G09B 19/24 |
| 2019/0104872 | A1* | 4/2019 | Khan | A47G 21/02 |

FOREIGN PATENT DOCUMENTS

| | | | |
|---|---|---|---|
| GB | 2 319 461 A | * | 5/1998 |
| KR | 2001-0046491 | * | 6/2001 |

* cited by examiner

EATING UTENSIL FOR FEEDING INFANTS

BACKGROUND

1. Field of the Invention

The present invention relates generally to eating utensils, and more specifically, to an eating utensil for feeding infants and for young children to feed themselves.

2. Description of Related Art

Eating utensils are well known in the art and are effective means to eat and serve food. For example, FIG. 1 depicts a conventional set 101 of eating utensils, including a knife 103, a fork 105, and a spoon 107. During use, the utensils of set 101 are used while eating.

Although appropriate for adults, set 101 is ineffective for feeding infants and for children to feed themselves. Commonly, the utensils of set 101 are composed of a hard metal and are too large for infants and small children to use.

Accordingly, although great strides have been made in the area of eating utensils, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
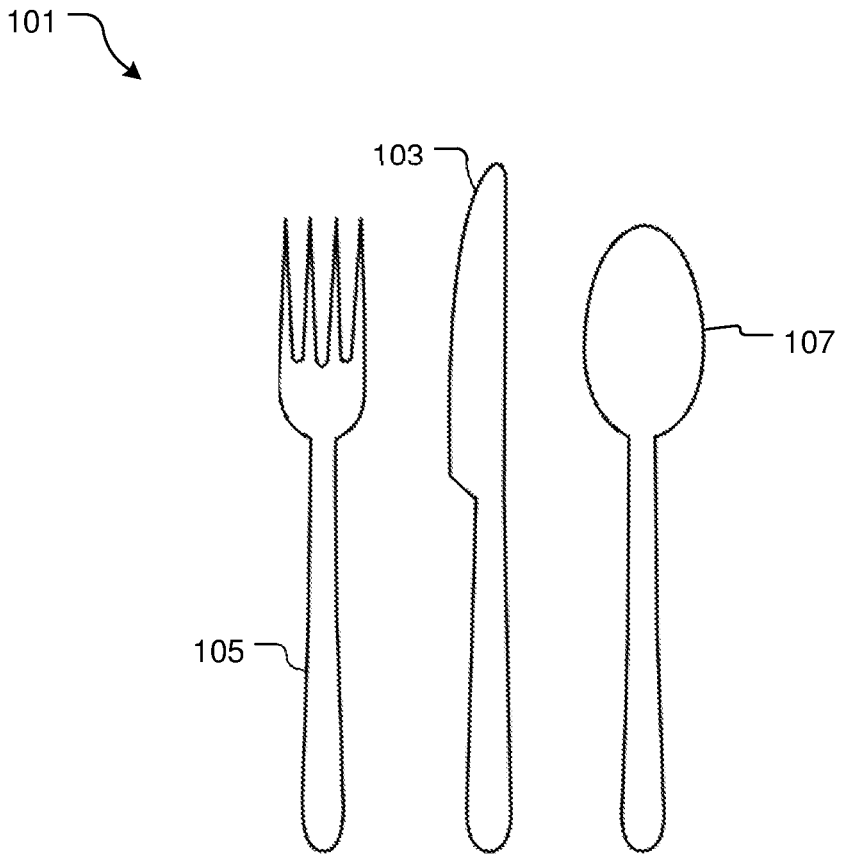
FIG. 1 (Prior Art)
FIG. 1 is a front view of a common set of eating utensils.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional eating utensils. Specifically, the present invention provides an eating utensil appropriate for feeding infants and for young children to feed themselves. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
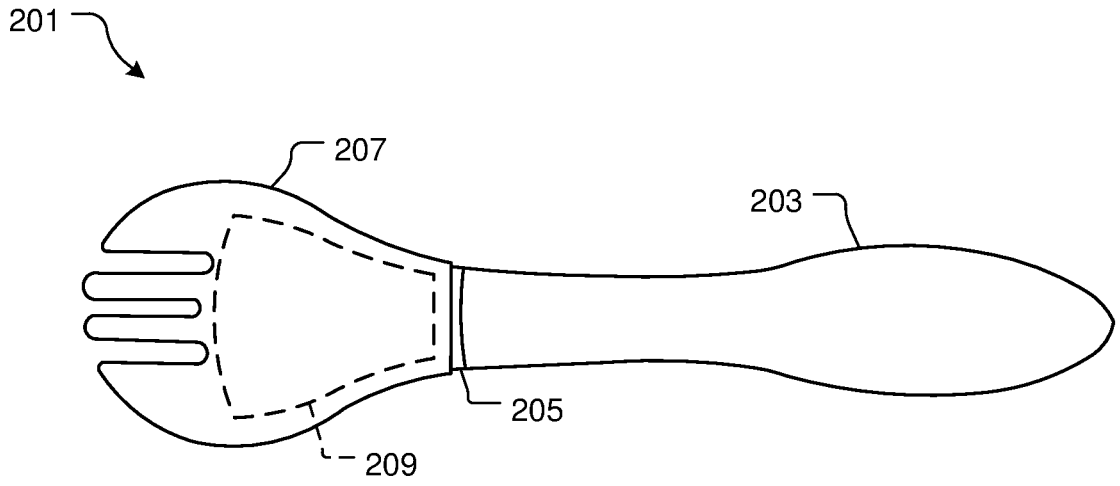
FIG. 2 is a top view of an eating utensil in accordance with a preferred embodiment of the present application.

Referring now to the drawings wherein like reference characters identify corresponding or similar elements throughout the several views, FIG. 2 depicts a top view of an eating utensil 201 in accordance with a preferred embodiment of the present application. It will be appreciated that utensil 201 overcomes one or more of the above-listed problems commonly associated with conventional eating utensils.

Figure 3:
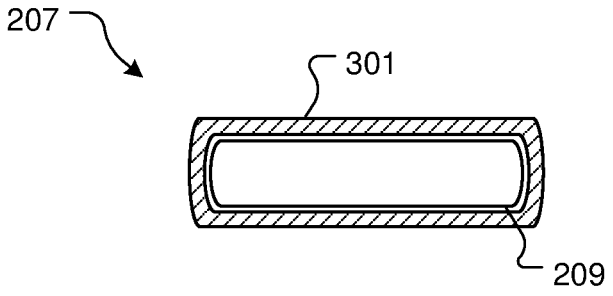
FIG. 3 is a cross sectional view of a feeding head of FIG. 2.

In the contemplated embodiment, utensil 201 includes an elongated handle 203 having a neck 205 positioned at one end. Utensil 201 further includes a feeding head 207 secured to neck 205 and a firm core 209 disposed within head 207. As shown in a cross sectional view of head 207 in FIG. 3, core 209 is surrounded on all sides by a soft outer shell 301. In the preferred embodiment, core 209 is composed of a compressed cotton material and outer shell 301 is composed of a silicone material.

It should be appreciated that one of the unique features believed characteristic of the present application is the composition of core 209. It should be understood that core 209 being composed of compressed cotton allows for head 207 to maintain an appropriate shape, while outer shell 301 provides for a soft surface to come into contact with a user's mouth. In addition, it should be appreciated that compressed cotton is considered baby safe and is free of BPA, PVC, and lead.

Figure 4A:
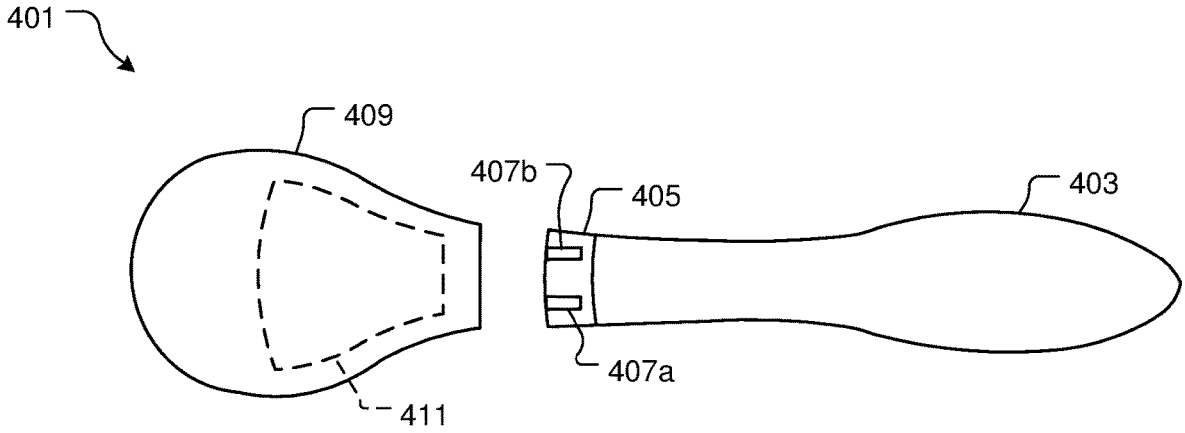
FIGS. 4A and 4B are top views of an alternative embodiment of an eating utensil in accordance with the present application.
Figure 4B:
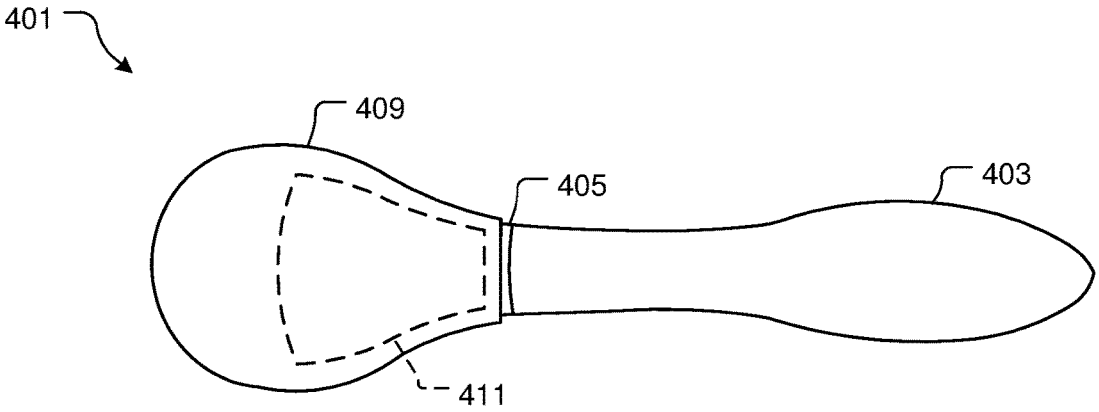

In FIGS. 4A and 4B, top views of an alternative embodiment of an eating utensil 401 in accordance with the present invention are shown. In the alternative embodiment, utensil 401 includes an elongated handle 403 having a neck 405 with one or more ridges 407*a*, 407*b* extending from neck 405. Utensil 401 further includes a head 409 removably connected to neck 405 by ridges 407*a*, 407*b*. Head 409 further includes a compressed cotton core 411 disposed within the interior of head 409.

Figure 5:
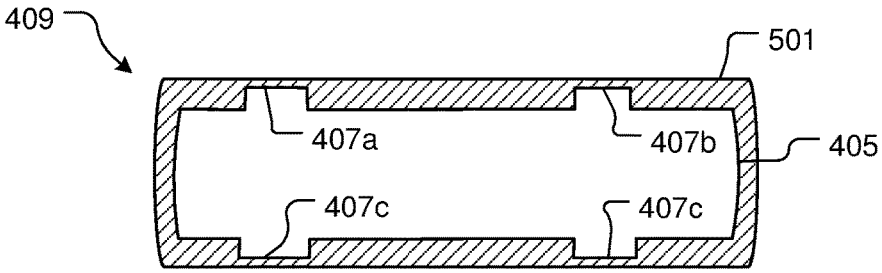
FIG. 5 is a cross sectional view an attachment means of FIGS. 4A and 4B.

As shown in FIG. 5, a cross sectional view of the attachment of head 409 to neck 405 is shown. In the contemplated embodiment, head 409 includes a soft outer shell 501 configured to compress and surround ridges 407*a-d* of neck 405. It should be understood that the compression of shell 501 allows for head 409 to be retained on neck 405 by pressure created between shell 501 and ridges 407*a-d*.

As demonstrated with the various embodiments, it is contemplated that the eating utensil of the present invention can be formed into a fork, a spoon, or a combination of the two. It should further be appreciated that the elongated handle of the various embodiments can be composed of a variety of materials, including wood such as bamboo, and can be hollow, making the eating utensil lighter and therefore easier to use by children.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An eating utensil adapted for feeding infants, the eating utensil consisting essentially of:

an elongated handle having a neck positioned at one end of the elongated handle;

a feeding head secured to the neck, the feeding head having:

a soft outer shell composed of a silicone material, and a core composed of a compressed cotton material, the compressed cotton material allowing the feeding head to maintain a predetermined shape;

wherein the soft outer shell surrounds the core, and the feeding head is in the form of a fork having a plurality of tines spaced from the core and integrally formed with the soft outer shell;

wherein the feeding head retains the predetermined shape when in use; and wherein the soft outer shell provides a barrier between an infant's mouth and the core.

2. The eating utensil of claim 1, wherein the elongated handle is composed of bamboo.

3. The eating utensil of claim 1, wherein the elongated handle is hollow.

* * * * *